US009297240B2

(12) United States Patent
Sultenfuss et al.

(10) Patent No.: US 9,297,240 B2
(45) Date of Patent: Mar. 29, 2016

(54) CYCLIC RADIO FREQUENCY STIMULATION

(75) Inventors: Daniel Sultenfuss, Houston, TX (US); Mark Trautman, Melbourne, FL (US); Francis Parsche, Palm Bay, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 927 days.

(21) Appl. No.: 13/476,124

(22) Filed: May 21, 2012

(65) Prior Publication Data

US 2012/0305239 A1 Dec. 6, 2012

Related U.S. Application Data

(60) Provisional application No. 61/491,643, filed on May 31, 2011.

(51) Int. Cl.
*E21B 43/24* (2006.01)

(52) U.S. Cl.
CPC ..... *E21B 43/2401* (2013.01); *E21B 43/24* (2013.01); *E21B 43/2408* (2013.01)

(58) Field of Classification Search
CPC ..... E21B 43/2401; E21B 36/04; E21B 43/24; E21B 43/2408; E21B 43/16; H05B 2214/03
USPC ..... 166/248, 303, 302
See application file for complete search history.

(56) References Cited

U.S. PATENT DOCUMENTS

| | | | | |
|---|---|---|---|---|
| 3,133,592 | A | 5/1964 | Tomberlin | |
| 3,522,843 | A | 8/1970 | New | |
| 3,522,846 | A | 8/1970 | New | |
| 3,522,848 | A | 8/1970 | New | |
| 4,456,065 | A * | 6/1984 | Heim et al. | 166/248 |
| 4,638,863 | A | 1/1987 | Wilson | |
| 4,817,711 | A | 4/1989 | Jeambey | |
| 4,912,971 | A | 4/1990 | Jeambey | |
| 5,082,054 | A | 1/1992 | Kiamanesh | |
| 6,189,611 | B1 | 2/2001 | Kasevich | |
| 7,091,460 | B2 | 8/2006 | Kinzer | |
| 7,703,317 | B2 | 4/2010 | Goodwin | |
| 8,453,739 | B2 * | 6/2013 | Parsche | 166/302 |
| 8,616,273 | B2 * | 12/2013 | Trautman et al. | 166/248 |
| 8,726,986 | B2 * | 5/2014 | Parsche | 166/248 |
| 2005/0199386 | A1 | 9/2005 | Kinzer | |
| 2007/0261844 | A1 * | 11/2007 | Cogliandro et al. | 166/248 |

(Continued)

FOREIGN PATENT DOCUMENTS

| | | |
|---|---|---|
| WO | 03010415 | 2/2003 |
| WO | PCT/US2012/038977 | 5/2012 |

*Primary Examiner* — Daniel P Stephenson
(74) *Attorney, Agent, or Firm* — Boulware & Valoir

(57) ABSTRACT

Production of heavy oil and bitumen from a reservoir is enhanced by cyclic radio frequency (RF) radiation of the well. The invention utilizes RF radiation to introduce energy to the hydrocarbon reservoir in cycles in order to heat the reservoir directly, yet conserves energy over the prior art processes that more or less continuously apply RF or microwave energy. The advantage of cyclic RF is it uses less electricity, and thus lowers operating costs. This is achieved by the soak cycle that allows heat to conduct into the formation and assists the heat penetration that is directly radiated into the formation by the antenna. The invention can also be advantageously combined with cyclic steam stimulation.

19 Claims, 3 Drawing Sheets

(56) References Cited

U.S. PATENT DOCUMENTS

| | | | | |
|---|---|---|---|---|
| 2008/0066536 | A1 | 3/2008 | Goodwin | |
| 2009/0090509 | A1* | 4/2009 | Vinegar et al. | 166/303 |
| 2009/0095478 | A1 | 4/2009 | Karanikas | |
| 2009/0173488 | A1 | 7/2009 | Varma | |
| 2012/0085533 | A1* | 4/2012 | Madison et al. | 166/248 |
| 2012/0305239 | A1* | 12/2012 | Sultenfuss et al. | 166/248 |
| 2013/0277045 | A1* | 10/2013 | Parsche | 166/248 |
| 2014/0131032 | A1* | 5/2014 | Dittmer | 166/248 |

* cited by examiner

CYCLIC RADIO FREQUENCY STIMULATION

PRIOR RELATED APPLICATIONS

This application claims priority to U.S. Ser. No. 61/491,643, filed May 31, 2011, and expressly incorporated by reference herein.

FEDERALLY SPONSORED RESEARCH STATEMENT

Not applicable.

REFERENCE TO MICROFICHE APPENDIX

Not applicable.

FIELD OF THE INVENTION

The invention relates to a method for enhancing heavy oil and bitumen production, and more particularly to a method of using cyclic radio frequency radiation to heat the water contained in the reservoir so as to mobilize the heavy oil.

BACKGROUND OF THE INVENTION

The production of heavy oil and bitumen from a hydrocarbon reservoir is challenging. One of the main reasons for the difficulty is the viscosity of the heavy oil or bitumen in the reservoir. At reservoir temperature, the initial viscosity of the oil is often greater than one million centipoises, which is difficult to produce if not mobilized using external heat. Therefore, the removal of oil from the reservoir is typically achieved by introducing sufficient energy into the reservoir to heat the reservoir, such that the viscosity of the oil is reduced sufficiently to facilitate oil production.

Currently the preferred method of introducing energy into the reservoir is steam injection. The heat from the steam reduces the viscosity of the fluid, allowing it to flow toward production wells. The steam also provides voidage replacement to maintain the pressure in the reservoir. Cyclic Steam Stimulation (CSS), steam drive, and Steam Assisted Gravity Drainage (SAGD) all use steam for heating and maintaining pressure in the reservoir.

In a typical cyclic steam production, as shown in FIG. 1, steam is injected into the reservoir and then allowed to "soak" as it transfers heat to the reservoir. This period is followed by a production period. When the oil production rate again diminishes, steam is again injected into the reservoir and the cycle is repeated. The steam injection during CSS provides heat and pressure support to enable production of the heavy oil or bitumen.

Although steam assisted oil production has proven to be quite valuable, it is not without drawbacks. Steam based methods for stimulating reservoirs containing heavy oil or bitumen use significant amounts of energy and water, most notably the energy to generate the steam in high temperature and transfer the steam into the reservoirs. Moreover, the steam injected into the reservoirs will eventually condense to water and is retrieved. Thus, it will require additional facilities and energy to treat the water before it can be recycled or exhausted. Finally, the availability of water on site may be a limiting factor in certain locations. Thus, other methods of transferring heat to heavy oils are of interest in the art.

For example, using microwave or radio frequency radiation to heat the oil reservoir and mobilize the oil have long been known in the art. U.S. Pat. No. 3,133,592 disclosed an apparatus for treating a subsurface petroleum reservoir by using a series of vertically spaced microwave energy generating units and means for generating and directing microwave energy into the reservoir to heat and mobilize the oil contained therein.

However, microwave radiation has limited penetration in oil sands, for instance at 2.45 GHz radio frequency and for rich Athabasca oil sands, which have an electrical conductivity of 0.002 mhos/meter, the 1/e or 64% penetration depth of electromagnetic heating energy may be only 9 inches. Thus, radio frequencies between about 0.001 and 30 MHz may be preferred.

U.S. Pat. No. 5,082,054 disclosed an in situ method for partially refining and extracting petroleum from a reservoir by irradiating the reservoir with electromagnetic energy, mainly in the microwave region, to heat and partially crack the hydrocarbons in the reservoir. However, to effect in situ upgrading the energy supplied has to be large enough to increase the temperature within the reservoir sufficient to trigger the cracking process. Thus this process is energetically quite expensive.

U.S. Pat. No. 6,189,611 discloses a method of producing a pool of subterranean fluid by radiating and modulating electromagnetic energy. However, U.S. Pat. No. 6,189,611 recites more or less continuous application of very large amounts of RF energy, sufficient to vaporize a portion of the hydrocarbon and propagate a material displacement bank away from the applicator well. It does not, however, contemplate a more limited usage of RF that is combined with a soak period, nor a limited RF combined with cyclic steam stimulation.

U.S. Pat. No. 7,091,460 discloses a method of automatically detecting and adjusting the radio waves used to heat hydrocarbon formations. Specifically, the patent measures an effective load impedance and compares that with an output impedance of a signal generating unit so as to match the former with the latter. Thus, U.S. Pat. No. 7,091,460 achieves an electrical load match while subjecting the transmission line to reflected energy circulation, e.g. a high voltage standing wave ratio. The resulting high power factor may cause transmission inefficiency so that the megawatt power levels of real world wells become difficult or impossible to attain. Further, the method is complicated and contributes to operating costs.

US2009173488 discloses a system for recovering oil from an oil shale deposit using a microwave generation system and a sheath to shield the antenna from harmful exposure to the corrosive oil components. The sheath, however, may not be necessary, as our work indicates that corrosion is not a problem.

Thus, what is needed in the art are better and more cost effective ways of using RF radiation to provide heat to a reservoir for enhanced oil recovery.

SUMMARY OF THE INVENTION

The present invention utilizes radio frequency (RF) radiation to introduce energy to the hydrocarbon reservoir in cycles in order to heat the reservoir directly, yet conserves energy over the prior art processes that more or less continuously apply RF or microwave energy. The advantage of cyclic RF is it uses less electricity, and thus lowers operating costs. This is achieved by including a soak cycle that allows heat to conduct into the formation and assists the heat penetration that is directly radiated into the formation by the antenna. Excessive operating temperatures can also be avoided with cyclic RF operation versus steady application or modulated application of microwave energies.

As a result of RF heating, some steam may be produced in-situ. Moreover, a desiccation region is created by such RF radiation, and by repeating the cycles the size of the desiccation region is expanded, which further facilitates the penetration of RF into the reservoir.

The RF will serve two purposes in this process: providing heat and maintaining pressure. The stimulation of the reservoir using RF will create a heating pattern around the well, which in turn creates steam from the water naturally occurred in the reservoir. The heat from the steam will transfer to the heavy oil or bitumen along with the heat directly radiated by the antenna and reduce hydrocarbon viscosity, thereby mobilizing the heavy oil or bitumen. The thermal expansion from the vaporization of the water will maintain the reservoir pressure at a level that will allow heavy oil or bitumen to be produced. The production can occur with or without using additional artificial lift methods.

According to one aspect of the present invention, there is provided a method for creating a desiccation region around a radio frequency heated well in a hydrocarbon reservoir, comprising: (i) providing a RF antenna inside the well, the RF antenna being connected to a transmitter; (ii) shutting in the production wells in the hydrocarbon reservoir, and (iii) generating and emitting RF energy at a first power level from the RF antenna in the form of electromagnetic energy to vaporize in-situ water surrounding the RF heated well, thereby creating a desiccation region around the RF heated well. A soak period is allowed during which RF is reduced significantly reduced to 0-25% of its initial power. Oil can then be produced, and the cycle then be repeated.

In one embodiment, a penetration depth $\delta_{desiccation}$ of the electromagnetic energy in the desiccation region is greater than a penetration depth $\delta_{reservoir}$ of the electromagnetic energy in the reservoir beyond the steam front. Penetration depth $\delta$ is defined as:

$$\delta = \sqrt{\frac{2\rho}{\omega\mu}}$$

where $\delta=1/e=1/2.78$; $\rho$=the formation electrical resistivity; $\omega$=the angular frequency=2 $\pi f$; and $\mu$=the magnetic permeability, which is roughly 1 for most hydrocarbon formations. In one embodiment, the penetration depth $\delta_{desiccation}$ of the electromagnetic energy in the desiccation region is 100 times greater than the penetration depth $\delta_{reservoir}$ of the electromagnetic energy in the reservoir beyond the steam front.

Generally speaking, the RF is applied at first and second power levels. In one embodiment, the first power level is 100% power, and the second power level is 0% power, so that during the second power level the previously emitted RF energies can soak in the reservoir before opening the production wells for production. Thus, the period during which the second power level is applied in known as a soak period.

The second power level is not limited to 0%, however, and other power levels are possible, depending on the conditions of different wells and/or hydrocarbon reservoirs. Preferably the second power level is low enough to allow previously emitted RF energies to soak into the reservoirs, which also reduces the energy consumption required in the heating process. However, some low level of power may still be beneficial, e.g., to support well pressures, yet be sufficiently reduced as to provide significant conservation of power. Thus, it is contemplated that the second power level could be as high as 25%, but more preferably is around 15% or 10% or 5%.

The operating power range for a cycle is from 0% to 100% of the design power. Specific operation levels in between 0 and 100% would be determined by monitoring oil production and reservoir pressure and temperature. For example, operation at 100% followed by a 25% power cycle will provide greater pressure support and higher average delivered power.

The "soak" period will of course vary with the conditions of the reservoir, but typical soak periods are typically 5-20 days. Generally, shorter soak periods are preferred as increasing yields.

In more detail, the invention in one embodiment is a method for enhanced oil recovery using cyclic radio frequency (RF) in a hydrocarbon reservoir, said method comprising providing RF energy at a first power level in a hydrocarbon reservoir, allowing a soak period during which RF energy is reduced by 75-100% of said first power level, repeating one or more times and collecting hydrocarbon from said hydrocarbon reservoir at one or more times.

In another embodiment, the method for enhancing the production of hydrocarbon from a hydrocarbon reservoir comprises providing a RF antenna inside a well located in the hydrocarbon reservoir, the RF antenna being connected to a transmitter, shutting in production wells in the hydrocarbon reservoir, applying a first power level from the RF antenna in the form of electromagnetic energy to vaporize in-situ water surrounding the RF heated well, thereby creating a desiccation region around the RF heated well, followed by allowing a soak period during which RF energy is emitted at a second power level that is 0-25% of said first power level. At an appropriate time, usually after one or more soaks, the production wells are opened for hydrocarbon production therefrom, and the entire cycle repeated whenever production decreases.

In another embodiment, the method of enhanced oil recovery combines cyclic steam stimulation with cyclic RF heating. Such method comprises first heating an oil reservoir with a first RF energy, allowing a soak period, during which RF energy is reduced to 0-25% of said first RF energy, heating the oil reservoir with steam injection (which can be during or after the RF soak period), optionally allowing a second soak period (during which RF can be again applied or RF can be applied afterwards), withdrawing oil from said oil reservoir and repeating the steps one or more times.

Yet another embodiment comprises stimulating a oil reservoir with cyclic RF, wherein the cyclic RF comprises i) at least 4 days of 100% RF energy, ii) at least 4 days of 0-25% RF energy, iii) followed by oil production, and iv) repeating steps i-iii), and the method can be combined with cyclic steam stimulation.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" (and their variants) are open-ended linking verbs and allow the addition of other elements when used in a claim. "Consisting of" is a closed term, excluding any other elements. "Consisting essentially of" occupies a middle ground, allowing the inclusion of non material elements, such as the addition of surfactants or solvents that do not material change the novel combination of the invention.

The following abbreviations are used herein:

| | |
|---|---|
| CSS | Cyclic steam stimulation |
| RF | Radio frequency |

As used herein "radio frequency (RF)" is defined as the frequency of electrical signals used to produce radio waves. Generally speaking the frequency can range between 30 KHz to 300 GHz, and in the present invention the radio frequency of the electromagnetic energy used is in the radio frequency range. In other words, preferably the radio frequency ranges of the present invention are between 0.001 MHz to 30 MHz.

The term "transmitter" is defined as an electronic device that generates radio energy through an antenna. Generally speaking, a transmitter generates a radio frequency alternating current that applies to an antenna, which in turn radiates radio waves upon the excitement of the alternating current.

The term "desiccation region" is defined as a region where substantially all the liquid water has been vaporized by the RF heating.

The term "cyclic" means that energy is applied in cycles, such that an energy application period is followed by a soak period where at least 75% less energy, preferably 80, 85, 90, 95 or 100% less energy is applied. Thus, cyclic RF application can easily be distinguished from the continuously modulated RF application where the RF energy is modulated to match load impedence as in U.S. Pat. No. 7,091,460.

As used herein "soak" means that RF power is reduced to at most 25% of normal operating power for a period greater than 2 days, preferably of at least 4 or 5 days.

DESCRIPTION OF EMBODIMENTS OF THE INVENTION

Figure 1:
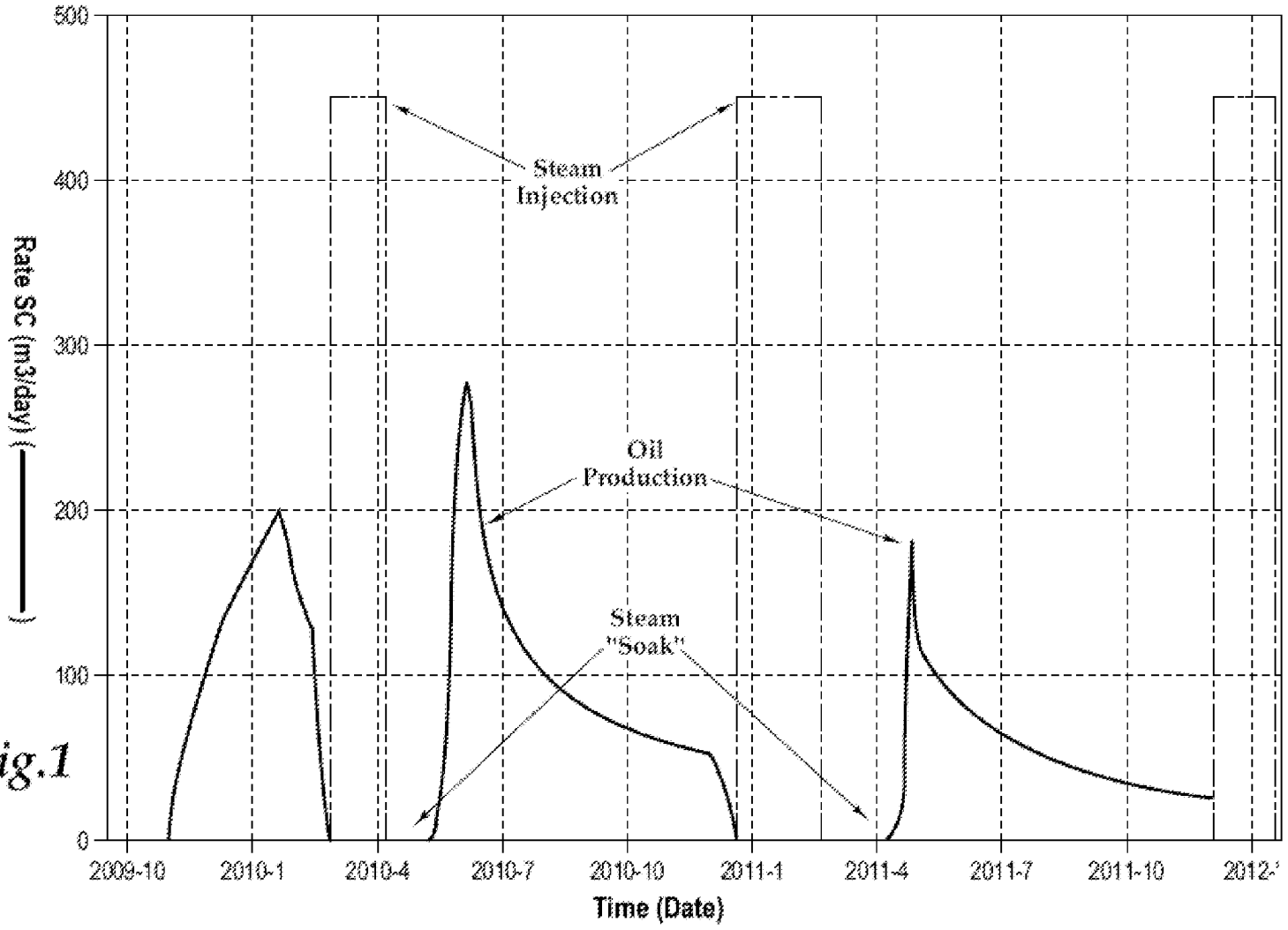
FIG. 1 shows the oil production and steam injection rates for conventional cyclic steam stimulation.

The present invention is exemplified with respect to using a linear antenna to radiate radio energy to heat and vaporize in situ water in the hydrocarbon reservoir. However, this example is exemplary only, and the invention can be broadly applied using other antenna configurations to heat other components in the hydrocarbon reservoir. The following examples are intended to be illustrative only, and not unduly limit the scope of the appended claims.

For one process in this invention, heat and pressure support would be provided by RF stimulation of the formation rather than steam injection. In steam injection methods heat convection and/or heat conduction are generally required to propagate the heating. RF stimulation may provide increased speed and penetration as RF fields can propagate through hydrocarbons without the need for conduction or convection. RF fields can penetrate mechanically impermeable layers to continue the heating where steam cannot. Therefore, RF stimulation may provide increased reliability of well stimulation.

RF radiation can be used to heat and pressurize the reservoir by creating steam from the water contained in the reservoir. A single well drilled in a pay zone can be completed with one or more antennae. RF radiation can then be used to stimulate the reservoir, causing the in situ water to vaporize and build pressure within the reservoir. The RF can then be switched off and the well is allowed to flow, bringing the pressure back down. The method can also be advantageously combined with steam production methods, e.g., cyclic steam production.

In one embodiment, the invention uses a long horizontal well that contains an RF antenna. The reservoir is stimulated with RF radiation until a suitable pressure and mobility is achieved to allow production from the well. The desired pressure can be above or below the fracture pressure of the rock. The RF is then turned off and fluids are produced from the well. Once pressure is depleted from the well, the well is shut in, and the RF radiation is turned on again. This cycle can be completed as many times as economically allowable. Each subsequent cycle will produce a larger desiccation zone that will allow the RF radiation to penetrate more deeply into the reservoir.

In another embodiment, the process can be converted to a displacement process (i.e. gas flooding or water flooding) once two contiguous wells are in pressure communication. Gas or fluid injection during the RF stimulation can supply additional heat and/or pressure to optimize the process. Optimization of the process may also show that continuing to stimulate the reservoir with RF during production is beneficial to re-vaporize water as it nears the wellbore. Time between RF stimulation and production cycles can also be altered to allow steam "soaking" in the reservoir to allow more effective heat transfer to the reservoir fluids.

Other embodiments of this invention can use slant, vertical, undulating, multilateral or deviated wells to increase the well's contact area with productive zones. Well placement within the pay zone can be designed to improve the process and production. Using multiple wells in various configurations can also be used to optimize this process. Yet another embodiment is using RF to heat the formation without vaporizing the in situ water.

In another embodiment, the invention combines cyclic RF stimulation with cyclic steam injection. In this method the formation is heated with an active cycle of RF followed by a cycle of steam injection and this process is repeated. Since the formation may not initially have good injectivity due to the high viscosity of the formation, it may be beneficial for an RF heating cycle to precede the steam injection cycle. The RF heats the hydrocarbon and lowers the viscosity to a point where it can be produced. The removal of the hydrocarbon provides voidage and improves injectivity for a subsequent steam cycle. The RF may then be turned off as the steam is injected into the formation. Steam injection stops after an appropriate duration, and a soak cycle may follow the steam injection or the process can return to RF heating as the hydrocarbon is produced.

This process of RF heating during what is traditionally the soak period of cyclic steam injection has several advantages. Firstly, RF can heat the formation when the initial formation conditions limit steam injection. Secondly, RF can supply heat and pressure support during the steam soak cycle. Thus, the average power delivered to the formation by using a combination of cyclic steam and cyclic RF may be higher than with cyclic steam injection alone, resulting in faster production of the hydrocarbon. The present invention enables this because unlike steam, RF does not require mass injection through the well to heat the formation. A third advantage is that steam provides some of the heating to the formation, so the electricity required may be less compared to cyclic RF alone.

The following examples are illustrative only, and are not intended to unduly limit the scope of the invention.

Example 1

Cyclic RF Stimulation

Figure 2:
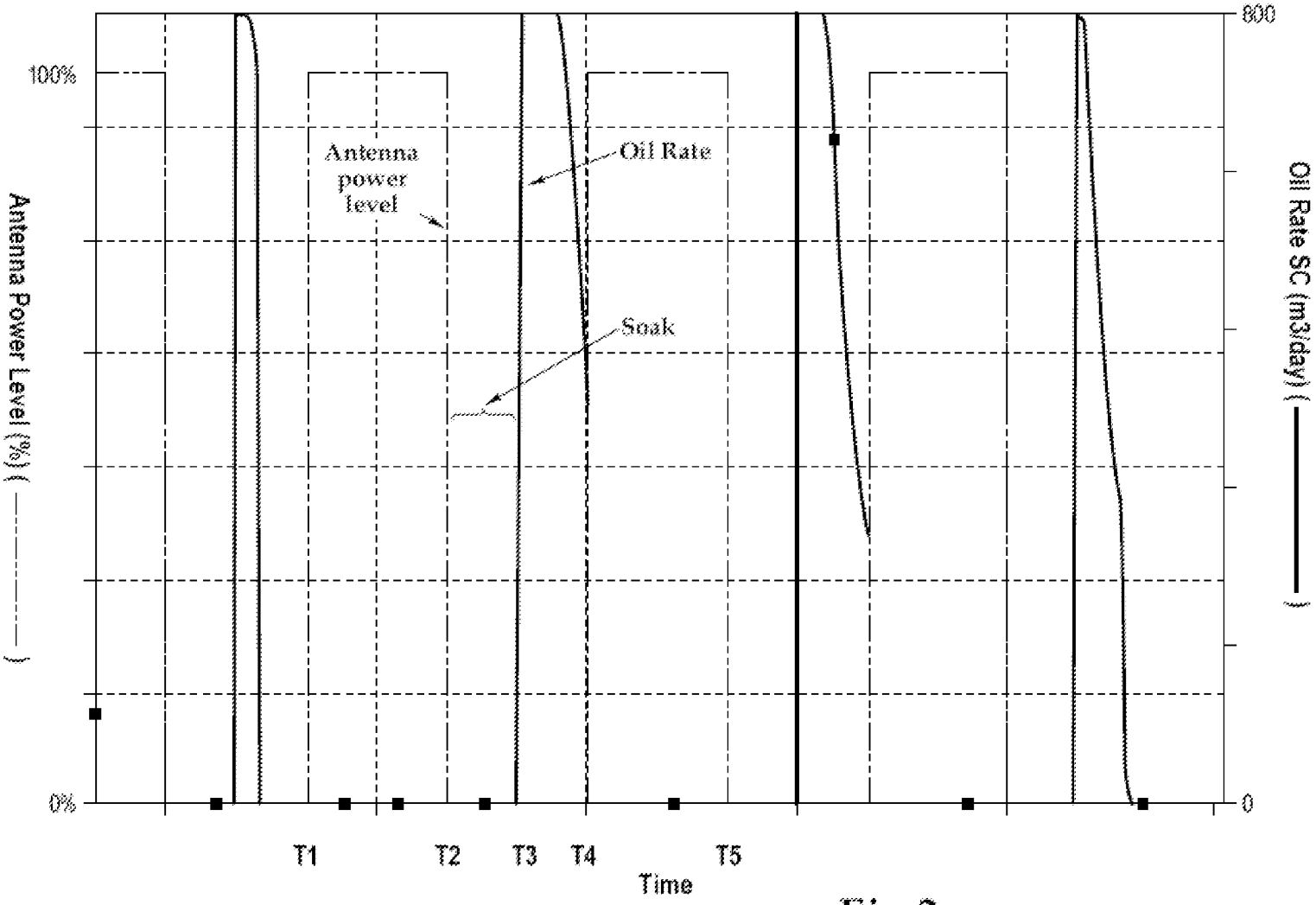
FIG. 2 shows the oil production and cyclic RF power for a typical cyclic RF stimulation process of the present invention.

FIG. 2 shows an embodiment of cyclic RF stimulation of the present invention. At time T1 the producer well is shut in and the RF power is cycled to a high level, for example 100%, for a period of time from T1 to T2, which should be sufficient to heat a region of hydrocarbon and increase the pressure of the reservoir. During this period, the RF energies may expand into the surrounding region through direct electromagnetic radiation, or by vaporization of the water and propagation of energies through the desiccated, low electrical conductivity region. Dry gas, steam or dielectric fluid may also be injected with the application of RF power.

At time T2, the RF power is cycled to a low level, for example 0%. Between time T2 and T3 the heat provided by the antenna or antennae is allowed to soak into the reservoir to heat and mobilize a larger region of the hydrocarbon resource. At the end of the soak period, indicated by T3, the producer well is opened and the hydrocarbons are produced. This recovery step occurs as long as the hydrocarbons are economically produced. In this example, the production period is between time T3 and T4.

At time T4, the hydrocarbon production rate decreases to a level that production is no longer economic, the producer again shut in and the RF power is cycled to the high operation level. The entire process described above, from time T1 to T4, is then repeated as many time as necessary to extract the hydrocarbon from the reservoir. The actual time period between events may vary and can be tailored for a given reservoir.

Cyclic RF stimulation may be employed to take advantage of time periods when electricity costs are lower (e.g., at night). This may improve the economics of the cyclic RF process. Cycling the RF power at intermediate levels between 0% and 100% are also possible to stimulate the recovery process.

Figure 3:
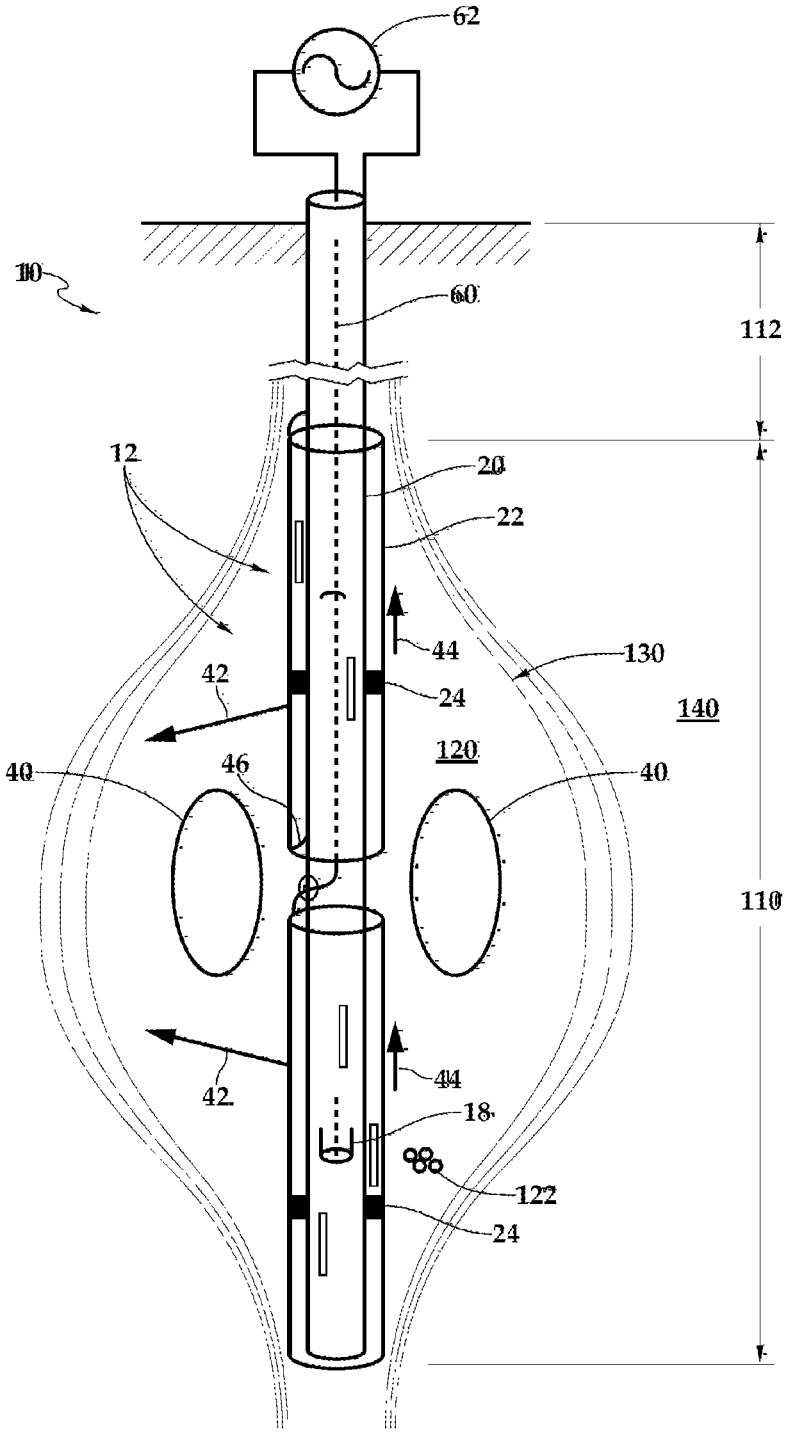
FIG. 3 is a schematic view showing a representative embodiment of the RF heated well.

A representative embodiment of the RF heated well is shown in FIG. 3. The RF heated well 10 is located in a hydrocarbon formation 110, which is preferably a heavy oil or bitumen formation. The condition shown in FIG. 3 is at a point of time where RF heating energies have been applied, so that heating of the underground formation has occurred, as discussed in more detail below.

An example linear antenna 12 is formed along the RF heated well 10. The linear antenna 12 generates electromagnetic heating energies, which may include curling magnetic field 40 and divergent electric fields 42. It is understood that the specific antenna configuration to be described is one example only. Many other antenna circuits can comprise the RF heated well 10 of the present invention, including but not limited to dipole antennas, slot antennas, monopole antennas and the like. Arrays of antenna can also be used.

In certain instances, the well pipe 20 itself may comprise the conductors of the linear antenna 12. The well pipe 20 may be ferrous or nonferrous depending on the radio frequency. At higher radio frequencies, nonferrous material may be preferred to minimize the magnetic skin effect from magnetic permeability of iron. In this embodiment, the conductive cylinders 22 are disposed over the well pipe 20 on insulators 24 so as to convey the antenna electric current 44. Transmission line conductor 60 conveys the electrical energy from the surface transmitter 62 through the overburden 112 without unwanted heating therein. Electrical connections 46 electrically connect the transmission line to the conductive cylinder 22. This embodiment also include pumping equipment 18 that is common in the configuration so as to convey the mobilized hydrocarbons 122 to the surface at the cyclic intervals.

The method for creating a desiccation region of the present invention will be discussed in more detail, as follows. In this method, relatively high rates of RF heating are used to produce a desiccation region 120 around the RF heated well 10 during cyclic RF heating period, so that the in situ liquid water is completely converted to steam. The desiccation region 120 then becomes nearly nonconductive electrically and the curling magnetic field 40 and divergent electric fields 42 expand in the desiccation region without significant dissipation to reach the steam front 130. At the steam front 130 the magnetic fields and electric fields 42 are quickly dissipated as heat in the rapid thermal gradient 132 in the hydrocarbon ore 110, therefore mobilizing the hydrocarbons. As a consequence, the desiccation region expands in size as more water is vaporized. In other words, the present invention provides a compound method to enlarge the heated volume by first heating the ore, which desiccates the ore, and in turn creates and expands an electrically non-conducting region underground, which in turn allows the curling magnetic fields 40 and divergent electric fields 42 to expand without dissipation.

Therefore, the embodiment of the present invention provides a synergistic mechanism to expand the heated zone (desiccation region) and the heating electromagnetic energies simultaneously. In the prior art steam injection methods, the reduced electrical conductivity of the heated region was of little benefit to propagate the steam or expand the heating because the heat transfer mechanism in those methods involves heat convection, not electrical conductivity. The method of the present invention, however, involves the propagation of electromagnetic energies, and the reduced electrical conductivity of the dry region allows propogation with little dissipation.

The 1/e depth of the thermal gradient 132 is at wave ranges proportional to the radio frequency skin effect and given by the following formula:

$$\delta = \sqrt{\frac{2\rho}{\omega\mu}}$$

where $\delta = 1/e = 1/2.78$ $\rho$=the electrical resistivity $\omega$=the angular frequency=$2\pi f$ $\mu$=the magnetic permeability, which is roughly 1 for most hydrocarbon formations The penetration depth in the desiccation region 120 is generally much greater than the penetration depth beyond the steam front 130. In other words, $\delta_{120} >> \delta_{130}$. In practice, $\delta_{120}$ is 100 times or more greater than $\delta_{130}$. The desiccation region 120 will typically comprise sands such as carbonates and silicates with steam and any residual hydrocarbons, and all of these materials have low dissipation factors to electromagnetic fields. Beyond the steam front the in situ liquid water causes a higher dissipation factor, which in turn results in the heating and vaporization of the water. The propagation factor of the radio frequency energy in the dessication region may derive from a cylindrical expansion so the energy may become weaker with $1/r^2$.

As discussed above, the method of the present invention provides an efficient way to mobilize the hydrocarbons in a reservoir by using cyclic RF heating. Specifically, the cyclic RF heating feature of the present invention provides continuous enhancement of production in a low energy consumption fashion that was not available in the prior art. This method can reduce the demand for water by using RF energy to vaporize water already contained in the reservoir to produce heat for fluid mobility and thermal expansion to maintain reservoir pressure. This process would also eliminate the significant capital and operating costs associated with steam generation and water treatment.

What is claimed is:

1. A method for enhanced oil recovery using cyclic radio frequency (RF) in a hydrocarbon reservoir, said method comprising:

i) providing RF energy at a first power level in a hydrocarbon reservoir to create a dessication region in said hydrocarbon reservoir, ii) allowing a soak period during which RF energy is reduced by 75-100% of said first power level, and iii) repeating steps i-ii) one or more times; and iv) subsequently collecting hydrocarbon from said hydrocarbon reservoir at one or more times.

2. The method of claim 1, wherein a steam front is created at the border of the desiccation region.

3. The method of claim 1, wherein a penetration depth $\delta_{desiccation}$ of the electromagnetic energy in the desiccation region is greater than a penetration depth $\delta_{reservoir}$ of the electromagnetic energy in the reservoir beyond the steam front.

4. The method of claim 3, wherein the penetration depth $\delta_{desiccation}$ of the electromagnetic energy in the desiccation region is 100 times greater than the penetration depth $\delta_{reservoir}$ of the electromagnetic energy in the reservoir beyond the steam front.

5. The method of claim 1, wherein providing RF energy is via an RF antenna placed into the oil reservoir.

6. The method of claim 5, wherein said RF antenna is a linear antenna, dipole antenna, slot antenna, monopole antenna or combinations thereof.

7. The method of claim 1, wherein the hydrocarbon is heavy oil or bitumen.

8. A method for enhancing the production of hydrocarbon from a hydrocarbon reservoir, comprising:

a) providing a RF antenna inside a well located in the hydrocarbon reservoir, the RF antenna being connected to a transmitter;

b) shutting in production wells in the hydrocarbon reservoir;

c) generating and emitting RF energy at a first power level from the RF antenna in the form of electromagnetic energy to vaporize in-situ water surrounding the RF heated well, thereby creating a desiccation region around the RF heated well;

d) allowing a soak period during which RF energy is emitted at a second power level that is 0-25% of said first power level;

e) opening the production wells in the hydrocarbon reservoir and producing hydrocarbon therefrom at a first rate; and f) repeating steps b) to e) when said first rate decreases.

9. The method of claim 8, wherein a steam front is created at the border of the desiccation region.

10. The method of claim 8, wherein a penetration depth $\delta_{desiccation}$ of the electromagnetic energy in the desiccation region is greater than a penetration depth $\delta_{reservoir}$ of the electromagnetic energy in the reservoir beyond the steam front.

11. The method of claim 10, wherein the penetration depth $\delta_{desiccation}$ of the electromagnetic energy in the desiccation region is 100 times greater than the penetration depth $\delta_{reservoir}$ of the electromagnetic energy in the reservoir beyond the steam front.

12. The method of claim 8, wherein the first power level is 100% power, and the second power level is 0% power.

13. The method of claim 8, wherein step d) lasts for a soaking period sufficient to allow the RF energy soak into the hydrocarbon reservoir to heat the hydrocarbons.

14. The method of claim 8, wherein the RF antenna is a linear antenna, dipole antenna, slot antenna, monopole antenna or combinations thereof.

15. The method of claim 8, wherein the hydrocarbon is a heavy oil or a bitumen.

16. A method of enhanced oil recovery, comprising stimulating a oil reservoir with cyclic RF, wherein the cyclic RF comprises i) at least 4 days of 100% RF energy, ii) at least 4 days of 0-25% RF energy, iii) followed by oil production, and iv) repeating steps i-iii).

17. The method of claim 16, wherein the method is combined with cyclic steam stimulation.

18. The method of claim 16 where step ii) is 0-10% RF energy.

19. An improved method of cyclic steam stimulation (CSS), wherein CSS comprises a cycle of injecting steam into a reservoir, allowing a soak period to heat oil, collecting the heated oil, and repeating said cycle when the heated oil production decreases, wherein the improvement comprising cyclic RF stimulation by applying RF power during said soak period.

* * * * *